United States Patent [19]

Munz

[11] 4,393,623

[45] Jul. 19, 1983

[54] ARRANGEMENT FOR MOUNTING A DOOR

[75] Inventor: Johann Munz, Hinwil, Switzerland

[73] Assignee: Team Form AG, Hinwil, Switzerland

[21] Appl. No.: 213,544

[22] Filed: Dec. 5, 1980

[30] Foreign Application Priority Data

Dec. 18, 1979 [DE] Fed. Rep. of Germany ..... 2950857

[51] Int. Cl.[3] ..... E05D 15/32

[52] U.S. Cl. ..... 49/248; 49/253

[58] Field of Search ..... 49/248, 246, 208, 253; 312/325

[56] References Cited

U.S. PATENT DOCUMENTS 1,009,889 11/1911 Brandenburg et al. ..... 49/253
1,407,790 2/1922 Evans, Jr. ..... 49/248 X
2,010,494 8/1935 McKnew ..... 49/248

FOREIGN PATENT DOCUMENTS 2013533 9/1971 Fed. Rep. of Germany ..... 49/248

*Primary Examiner*—Philip C. Kannan
*Attorney, Agent, or Firm*—Michael J. Striker

[57] ABSTRACT

The arrangement for mounting a door pivotable about a vertical axis and guided for parallel displacement relative to a housing has a guiding element arranged to guide a door for parallel displacement, and a supporting element arranged to support the door on the housing and pivotably connected with the latter. The supporting element is composed of two separate shaped members which are mirror-inverted relative to one another and each having a horizontally extending leg and a vertically extending leg. The vertically extending legs have adjustable length and, upon adjustment of relative position of the horizontal legs, are fixedly connected with one another for joint rotation.

19 Claims, 15 Drawing Figures

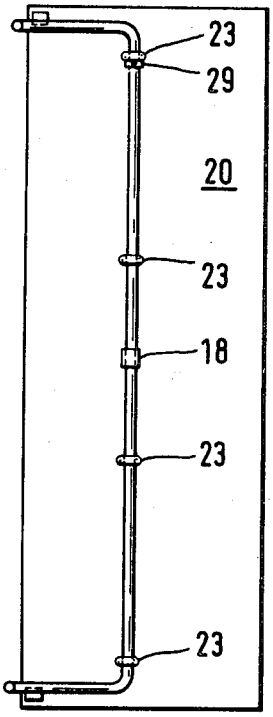
FIG. 3
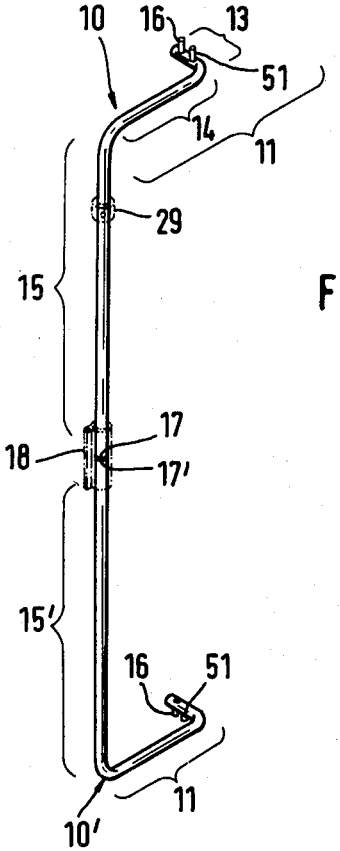
FIG. 4
FIG. 6c
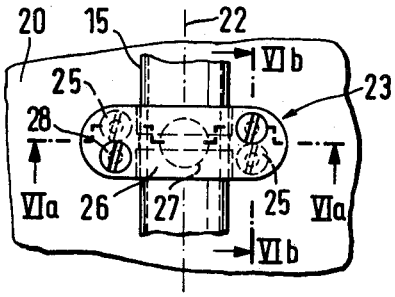
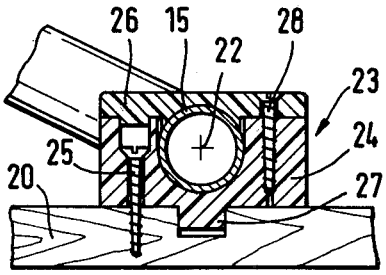
FIG. 6a
FIG. 6b
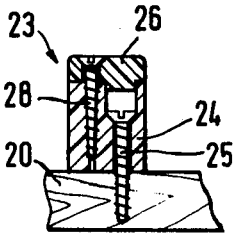

ARRANGEMENT FOR MOUNTING A DOOR

BACKGROUND OF THE INVENTION

The present invention relates to an arrangement for mounting a door so that it pivots about a vertical axis and is guided for parallel displacement.

Arrangements of the above-mentioned general type are known in the art. A known arrangement has upper and lower supporting arms which together form a frame-like rigid element, and a guiding arm having pivot points which are offset relative to the pivot points of the supporting arms. When the arrangement has the above-described construction, the door during its opening and closing is guided parallel to itself, whereby relatively wide doors require a relatively small free space for their movement. In open position of the door, the door opening is completely unobstructed. One such arrangement is described, for example, in the German Gebrauchsmuster No. 1,804,634. The arrangement has a rigid supporting element formed as a one-piece U-shaped bracket and having an end portion provided with pivot pins which are received in fixed bearings of the vehicle.

The entire supporting element is arranged in a vertical plane. The vertical axis is formed by a throughgoing web of the U-shaped bracket and received in a housing of the door. The known arrangement possesses the disadvantage that for each height of a door a special supporting element must be manufactured. Even when the dimensions of the door are limited to standardized values, supporting elements of different lengths are required which leads to an indefinite holding means. With the above-mentioned rigid supporting element, it is also difficult to provide all-sided good abutment of the door in closed position. Unavoidable play which accompanies the longer supporting arms and mounting non-uniformity leads to formation of gaps at some locations of the door in closed position. In the vehicle doors having a great width, small door gaps can be closed with the aid of elastic sealing strips extending on the periphery of the door. However, it is not so for the doors for cabinets and the like. In the case of high and wide cabinet doors required for cooperation with cabinet walls, in the closed position of the door gaps remain which can no longer be closed by the sealing strips. The known supporting element must have a high accuracy during its manufacture and mounting, which is difficult to provide in a mass product such as cabinets and the like.

SUMMARY OF THE INVENTION

Accordingly, it is an object of the present invention to provide an arrangement for mounting a door, which avoids the disadvantages of the prior art.

More particularly, it is an object of the present invention to provide an arrangement for mounting a door, which has a simple, inexpensive construction and is characterized by a longer service life and good abutment of the door in its closed position.

In keeping with these objects and with others which will become apparent hereinafter, one feature of the present invention resides in that a supporting element which is arranged to support the door is composed of two separate shaped members which are mirror-inverted relative to one another and each has a horizontally extending leg and a vertically extending leg extending in different planes and an intermediate web which connects said legs with one another, wherein the vertically extending legs can be cut into desired lengths and, upon adjustment of relative position of the horizontal legs, are fixedly connected with one another for joint rotation.

When the vertical legs of shaped members are connected with one another, the torque is transmitted from the door to the horizontal legs so as to attain the desired pressure of the door in its closed position, which otherwise has a gap. In order to provide adjustment for attaining play-free abutment of the door in its closed position, the vertical legs are disconnected from one another, the door is pressed against the cabinet at a location wherein a gap is found, and in this pressed position the vertical legs are connected with one another again. Thereby, the supporting element can be adjusted in a simple mounting-favorable manner even by inexperienced persons. Subsequent adjustment of the supporting elements is also possible in the above-mentioned manner when the wood of the cabinet or the door is distorted.

For a wide range of doors having different heights, substantially uniform sets of shaped members can be utilized. The required length can be provided by cutting of the superfluous end portions of both vertical legs of the shaped members. It is not necessary to utilize very meticulous methods for this adjustment when the connection of the vertical legs of the shaped member is performed so that their end faces abut against one another and the vertical legs are connected with one another by an embracing sleeve.

The connection of the supporting element with a door is especially simple when holding members are arranged on the rear side of the door, and the vertical legs of both shaped members engage in the holding members so as to form bearings. Thereby, the door becomes pivotable about its longitudinal axis. This construction can also be utilized for suspension of the door when a radial shoulder is provided on each vertical leg of the shaped members so that the door is suspended on this shoulder. In a simple case, the radial shoulder can be formed as an adjusting ring which is fixed on the vertical leg and engages with the holding member. The height of the door can be adjusted when an adjustment means is provided between the above-mentioned holding element and the shoulder. This adjustment means may be composed, for example, of a transverse pin provided on the vertical leg and a ring member provided with a plurality of grooves having different depths in which the transverse pin can engage.

In order to further reduce undesirable sagging of the door, the pivot point located adjacent to the housing is formed by a track member which is parallel to a pivot plane of the shaped members, and a running member mounted on the horizontal leg of respective one of the shaped members and arranged to run over the track member. The track member may include a bearing plate and a circular collar extending from the bearing plate and supporting the running member during its running over the track member. The horizontal leg of the shaped member may be provided with a pivot pin engaging in a receiving central portion of the circular collar.

The track member may serve simultaneously as an arresting means for arresting the door in respective positions, such as for example in its open position and its closed position. For this purpose the track member is provided with a respective guiding profile, and the running member is elastically urged toward the track member so as to engage in recesses of the profile of the track member. The running member may be formed as a roller arranged on a telescoping device which is provided on the horizontal leg of the shaped members and runs over the height-variable circular collar of the track members.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 3 is a rear view of the door with a supporting element of the arrangement in accordance with the present invention;

FIG. 4 is a perspective view of the supporting element of the inventive mounting arrangement;

FIGS. 6*a*, 6*b* and 6*c* are views showing a holding member of the inventive arrangement;

DESCRIPTION OF THE PREFERRED EMBODIMENTS

Figure 5:
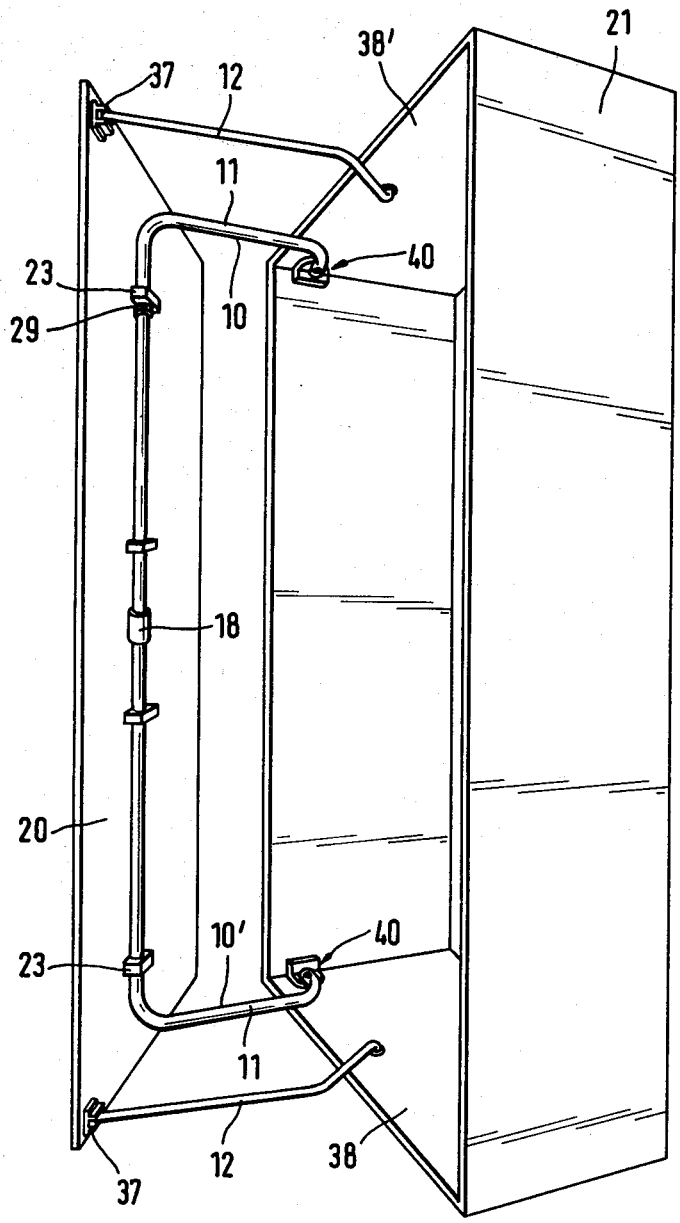
FIG. 5 is a perspective view of a cabinet with a door connected with the cabinet by the inventive arrangement.

As can be better seen from FIG. 5, an arrangement for mounting a door 20 on a cabinet housing 21 includes two levers 11 and 12. The levers 11 and 12 have lengths which correspond to one another, but they are provided with laterally offset pivot points. Thereby, the door 20 in each position during its opening is located parallel to its completely closed position 20' shown in FIG. 1 or to its completely open position 20'' shown in FIG. 2.

Figure 1:
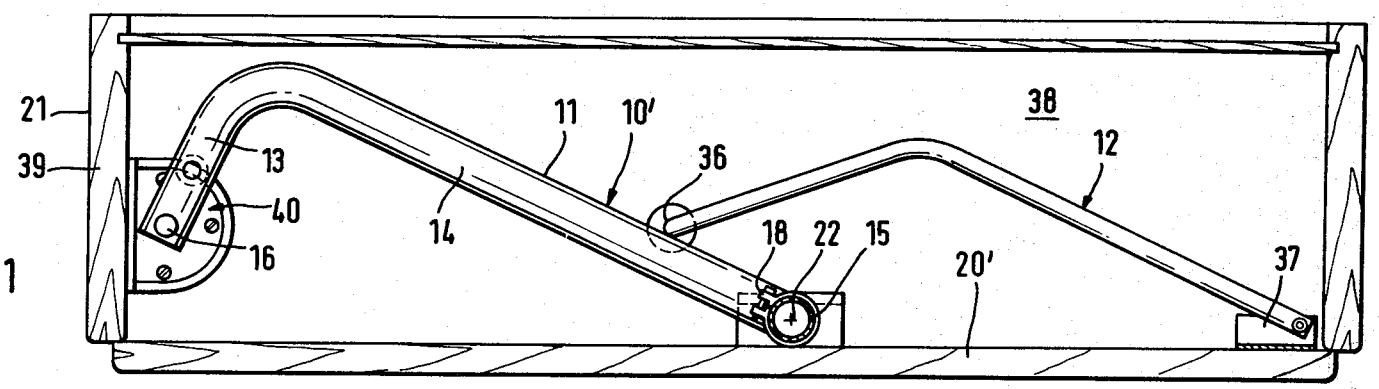
FIG. 1 is a view showing a cabinet or the like provided with an arrangement for mounting a door in accordance with the present invention, wherein the door is completely closed.

The first lever serves as a supporting arm 11 for holding the door, whereas the second lever serves as a guiding arm 12 for guiding the door during its above-mentioned parallel displacement. The door is pivotable about a pivot axis 22 provided in the central zone, as shown in FIG. 1. The pivot axis is defined by the pivot points of the two supporting arms 11 at the side of the door. It suffices to provide only one guiding arm 12 which, as shown in FIG. 1, has a different curvature as compared with the supporting arms 11.

Both supporting arms 11 are formed as rigid tubular shaped members which are mirror-inverted relative to one another so that manufacture, matching and mounting of the arrangement are performed in advantageous manner. Each profiled member forms a one-piece shaped member 10 or 10' which extends as will be discussed in detail hereinbelow. Since they have the mirror-inverted shape, it suffices to describe only one of the shaped members 10.

Figure 9:
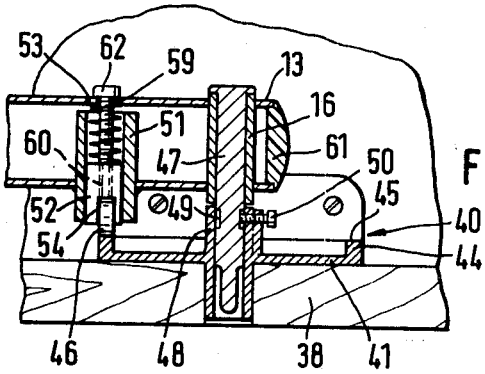
FIGS. 9 and 10 are axial and plan views of a bearing provided at the side of the cabinet.

The member 10 includes a short end leg 13 connected with an intermediate web 14. Even though it is not necessary for the operation, the member 10 extends substantially in a horizontal plane and forms the angled carrying arm 11 which serves as a lever. The horizontal leg 13 carries pins 16 for supporting the members 10, 10'. The pins 16 can be welded to the tubular shaped member as shown in FIG. 9.

Figure 8A:
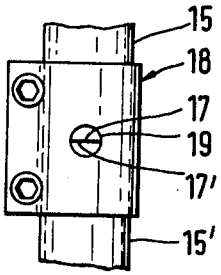
Figure 8B:
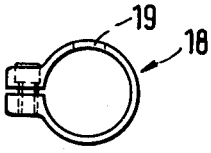

The member 10 further has a vertical leg 15 which extends in the longitudinal direction of the door toward a mirror-inverted vertical leg 15' of the lower member 10'. The horizontal leg 13 and the vertical leg 15 of the member 10 are located in different planes so that they form together with the intermediate web 14 a shaped member. The same is true with regard to the legs of the member 10'. In mounted condition shown in FIGS. 4 and 8, the end faces 17 and 17' of the vertical legs 15 and 15' can abut against one another so that in condition of loading they sufficiently transmit the force flux. In order to connect the end portions of the legs 15 and 15', a connecting sleeve 18 surrounds the end portions, and thereby the members 10 and 10' are fixedly connected and cannot rotate relative to one another. The sleeve 18 is formed here as a C-shaped clamp which is fixed by screws and has a side wall provided with an opening 19 for observing the abutment of the end faces 17 and 17'. In order to guarantee that in the closed position 20' the door is pressed against the opening 35 of the cabinet 20 at all sides, the connecting sleeve 18 is fixed in condition of the pressed doors. The members 10 and 10' can be fixed in deliberately twisted position so as to provide the all-sided abutment of the door.

The vertical legs 15 and 15' fixedly connected with one another together form a vertical shaft on which the door 20 is pivotably mounted with the aid of holding members 23, as can be seen from FIG. 3. The holding members 23 surrounds the vertical legs 15 and 15' having a round cross-section. It is possible to utilize an Ω-shaped holding member with its end fixedly mounted by screws on the rear side of the door. However, a different construction is shown in FIGS. 6*a*–6*c*. Here the holding member 23 is composed of two parts including a lower portion 24 connected by screws with the rear side of the door, and an upper portion 26. To guarantee exact positioning of the door, the lower portion 24 is provided with a bottom projection 27 which engages into the door 20. The complementary shaped upper portion 26 is placed onto the lower portion 24 after insertion of the shaped member 15 and connected with the lower portion 24 by screws 28. Predetermined play remains between the holding member 23 and the vertical legs 15 in mounted condition so as to allow the rotation of the latter relative to the former. Thereby, an axis of rotation 22 is formed for the door 20.

Figure 7:
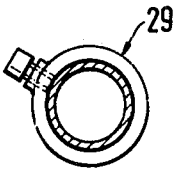
FIGS. 7, 8*a* and 8*b* are views showing suspension members provided on the supporting element for suspending and coupling of the door.

The vertical legs 15 and 15' connected with one another also serve for suspension of the door 20. In accordance with one embodiment of the invention, a clamping ring 29 shown in FIG. 7 can be fixedly connected with the vertical legs 15 and 15' at a predetermined height with the aid of a screw, as shown in FIGS. 3 and 4. The upper holding member 23 of the door 20 supports on the upper end face of the fixedly mounted clamping ring 29, as can be seen from FIG. 3, so as to take the weight of the door 20.

In order to provide for exact height adjustment of the door 20, it suffices to somewhat release the screw of the clamping ring 29, and after respective stepless adjustment again to fix the screw. Even though it is not necessary, several or all holding members 23 can be utilized for such abutment for uniform load distribution.

Figure 11:
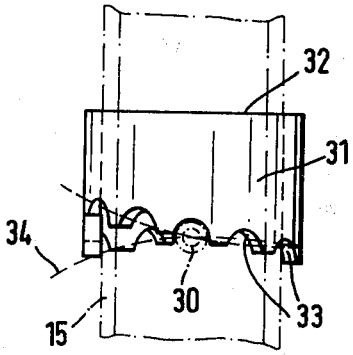
FIG. 11 is a side view of a device for height adjustment of the door.

The vertical legs 15 and 15' can be provided for door suspension not with a clamping ring 29, but with suitable abutment shoulders, such as for example radial lugs or a clamping pin 30 fixed on the tubular shaped member, as shown in FIG. 11. In such a construction it is possible to provide a height adjustment means formed as a crown ring 31. The crown ring 31 serves as a supporting disk which cooperates with the above-mentioned holding member 23 of the door and has an upper smooth end face 32 forming an abutment. Thereby, it provides the same action as the above-mentioned clamping ring 29. The lower end face of the crown ring 31 is provided over its entire circumference with a continuous row of depressions 33 which form the crown-shaped appearance of the ring 31. The row of depressions 33, as shown in FIG. 11, is arranged along a wave line which has a small increase. The height difference between the neighboring depressions 33 in which the clamping pin 30 can engage during turning of the crown ring 31, is small and can amount to several millimeters. The adjustment of the door height can be performed by simple lifting and turning of the crown ring which can be performed without an additional tool.

Figure 2:
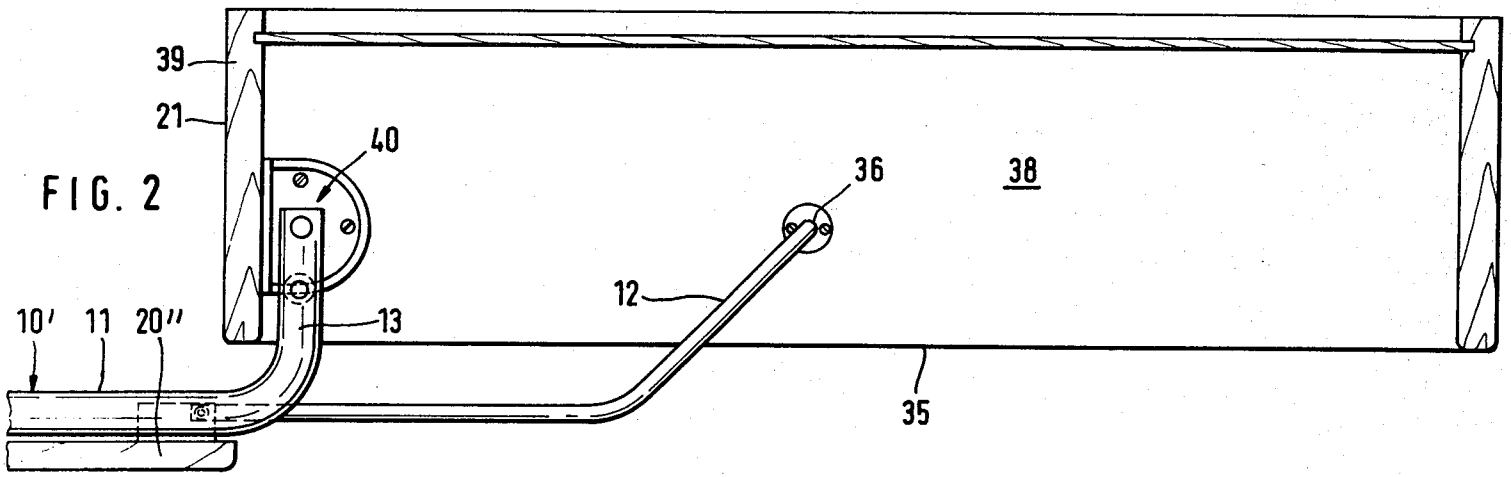
FIG. 2 is a view substantially corresponding to that of FIG. 1, but showing the door in a completely open position.

The pivot point for the supporting arms 11 of both shaped members 10 and 10' is offset relative to the plane of an opening 35 of the cabinet, as shown in FIG. 2. The same is true with respect to pivot point 36 of the guiding arms 12. The free end of the guiding arm 12 is pivotally connected with the door 20 in the edge region of the rear side by a bearing block 37 having a flange. By release of the pivot pin from the bearing block 37 and the snap connection in the pivot point 36, the guiding arm 12 can be easily dismounted without endangering its operational safety.

Figure 10:
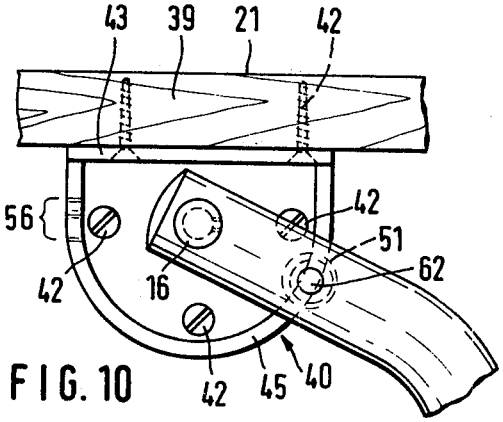

FIGS. 9 and 10 show the construction of a bearing 40 of the shaped members 10 and 10'. The bearing 40 includes, as can also be seen from FIGS. 1, 2 and 5, a bearing plate 41 which is mounted by screws on a bottom wall 38 or a top wall 38' of the cabinet 21. The bearing plate 41 has throughgoing openings for mounting screws 42 and is shaped in a special way. The bearing plate 41 has a circular contour and is provided with a flange 43 at its one side. The flange 43 flatly abuts against a side wall 39 of the cabinet 21 and connected with the same by further throughgoing mounting screws 42. The bearing plate 41 can serve also as a mounting member for connecting the bottom wall and the side walls 38 and 39.

The bearing plate 41 has a raised web 44 extending over the circumference of the bearing plate and having an upper face which forms a track 45 for a roller 46 which runs over the same. The above-mentioned pin 16 on the end portion of the horizontal leg 13 is formed as a sleeve, and an axial pin 47 is received in the sleeve-shaped pin 16. The axial pin 47 engages in a bush 48 provided in the central region of the bearing plate 41. The bush 48 is inserted in the material of the bottom wall 38 or top wall 38' of the cabinet. The engaging position of the pin 47 is provided by a safety screw 50 which is screwed into a groove 49 of the pin 47.

A guiding sleeve 51 is inserted in and fixed to the tubular shaped member of the horizontal leg 13. The guiding sleeve is located at a distance from the axis of the pin 47, which corresponds to the radius of the track 45. A piston 52 is telescopically movable in the guiding sleeve 51 and spring-biased by a pressure spring 53 in direction of displacement outwardly. The piston 52 has a fork-shaped recess 54 in which the roller 46 with its axle is received.

In mounted condition, the roller 46 runs over the track 45 with prestress by the spring 53. The aligned position of the roller 46 with its track 45, which must also take place during the rotation of the horizontal legs 13, is guaranteed by non-rotatable mounting of the guiding sleeve 51 and the piston 52. In the present construction it is attained by the fact that the guiding sleeve 51 and the piston 52 have a non-round cross-section, as can be seen from the different wall thickness in FIG. 9.

Figure 12:
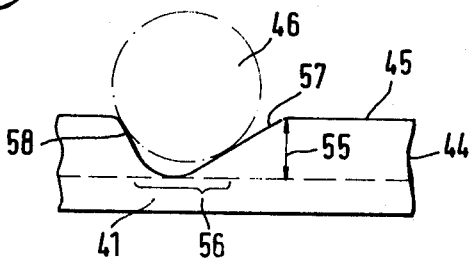
FIG. 12 is a view showing a fragment of the device for fixing the position of the door.

Means may also be provided for arresting the door in a respective position during its turning, for example in its open and closed positions as shown here. At the same time, the door 20 can be automatically driven in the final movement phase. In order to attain the above-mentioned object, the track 45 is profiled at predetermined locations by changing the height of the web 44, as shown in FIG. 12. The shape of the web 44 is shown in a region 56 in which the roller 46 is located in a completely open position of the door, that is in the position 20'' of FIG. 2. The web 44 has a decreased height 55 so as to form an inclined ramp 57 over which the roller 46 runs automatically so that a start effect takes place. The other flank of the depression 56 is so steep that it forms an abutment for the roller 56 and thereby provides for braking of the door movement. The dimension of the supporting arms 11 guarantees the entire turning of the open door 20'' relative to the opening 35 of the cabinet 21 so as to engage the edge of the opening of the cabinet in the region of the side wall 29.

The track 45 is identically shaped at the location corresponding to the closed position 20' of the door. Advantageously, the flanks of the web depression are steeper in this case, in order to increase the arresting effect.

In order to facilitate the mounting, the horizontal legs, as shown in FIGS. 9 and 10, are provided with a through opening 59. For assembling of the arrangement which has been disassembled for shipment purposes into its components 10, 10' and 12, a screw 62 is inserted into the through opening 59 so as to engage into an inner thread 60 of the piston 52 shown in FIG. 9. Thereby first the piston 52 which holds the roller 46 and the pressure spring 53 are connected to the respective shaped member. With the aid of this screw it is possible, after the mounting of the shaped member, to pull back in the pivot point 40 the entire unit in the guiding sleeve 51, so that to provide undisturbed inner engagement of the bearing parts. After this, the screw is simply further screwed out, and the above-mentioned non-round cross-section of the telescoping arrangement is utilized during this process.

As can be further seen from FIG. 9, an end opening of the tubular shaped member is closed by a suitable plug of synthetic plastic material 61 or the like.

It will be understood that each of the elements described above, or two or more together, may also find a useful application in other types of constructions differing from the types described above.

While the invention has been illustrated and described as embodied in an arrangement for mounting a door, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for mounting a door pivotable about a vertical axis and guided for parallel displacement relative to a housing, the arrangement comprising at least one guiding element arranged to guide a door for parallel displacement relative to a housing and pivotally connected with the former and the latter in predetermined pivot points; and a supporting element arranged to support the door on the housing and pivotally connected with the latter in further pivot points which are offset relative to the first mentioned pivot points, said supporting element including two separate shaped members which are mirror-inverted relative to one another and each has a horizontally extending leg and a vertically extending leg extending in different planes and an intermediate web connecting said legs with one another, said vertically extending legs can be cut into desired lengths and upon adjustment of the relative position of said horizontal legs in different vertical planes, being fixedly connected with one another for joint rotation.

2. An arrangement as defined in claim 1, wherein said vertical legs have proximal end portions abutting against and detachably connected with one another; and further comprising means for detachably connecting said proximal end portions of said vertical legs with one another.

3. An arrangement as defined in claim 2, wherein said connecting means includes a sleeve surrounding said proximal end portions and connecting the same with one another.

4. An arrangement as defined in claim 1; and further comprising at least two holding members arranged to be mounted on a rear side of the door, the vertical legs of each of said shaped members being rotatably received in a respective one of said holding members so as to form a pivot bearing.

5. An arrangement as defined in claim 4; and further comprising means for suspending the door on one of said shaped members.

6. An arrangement as defined in claim 5, wherein said suspending means includes a shoulder arranged on the vertical leg of said one shaped member.

7. An arrangement as defined in claim 6, wherein said shoulder is formed by an adjusting ring which is fixedly mounted on the vertical leg of said one shaped member and engages from below with the holding member which surrounds the vertical leg of said one shaped member.

8. An arrangement as defined in claim 6, wherein said suspending means includes a radial projection formed on the vertical leg of said one shaped member, and distance adjusting means arranged so that the holding member surrounding the vertical leg of said one shaped member is supported on said shoulder with interposition of said distance adjusting means and the distance between said holding member and said shoulder can be adjusted.

9. An arrangement as defined in claim 8, wherein said adjusting means includes a ring member arranged on the vertical leg of said one shaped member and provided with a plurality of grooves having different depths, and a pin fixedly connected with the vertical leg of said one shaped member and engageable in a respective one of said grooves of said ring member.

10. An arrangement as defined in claim 1; and further comprising means forming one of sid further pivot points, which is adjacent to the housing, said pivot point forming means including a track member arranged parallel to a pivot plane of said shaped members, and a running member mounted on the horizontal leg of a respective one of said shaped members and arranged to run over said track member.

11. An arrangement as defined in claim 10, wherein said track member includes a bearing plate arranged to be mounted on the housing, and a height-variable circular collar extending from said bearing plate and supporting said running member during its running over said track member.

12. An arrangement as defined in claim 11, wherein said circular collar has a center, and is provided with a receiving portion in said center, the horizontal leg of said one shaped member having an end portion located adjacent to the housing and provided with a pivot pin which engages in said receiving portion of said circular collar.

13. An arrangement as defined in claim 10; and further comprising means for elastically urging said running member against said track member.

14. An arrangement as defined in claim 13, wherein said track member is shaped at predetermined locations so as to arrest said running member at said locations and thereby arrest the door in respective positions relative to the housing.

15. An arrangement as defined in claim 14, wherein said track member is shaped so that said running member is arrestable at such locations which correspond to at least open and closed positions of the door.

16. An arrangement as defined in claim 13, wherein said urging means includes two telescopable members and a spring biasing said telescopable member from one another, one of said telescopable members being fixedly connected with the horizontal leg of said one shaped member, whereas the other of said telescopable members is connected with said running member.

17. An arrangement as defined in claim 16, wherein said running member is a roller.

18. An arrangement as defined in claim 1, wherein said vertically extending legs of said shaped members are arranged so that they can be cut into required lengths so as to provide for adjustment of their lengths.

19. An arrangement as defined in claim 1, wherein said shaped members are arranged so that upon the adjustment of the relative position of said horizontally extending legs said shaped members can be twisted relative to one another and upon fixed connection of said vertically extending legs with one another said shaped members are retained in twisted condition.

* * * * *